US006298816B1

(12) United States Patent
Marentette

(10) Patent No.: US 6,298,816 B1
(45) Date of Patent: Oct. 9, 2001

(54) VACUUM SEAL FOR AIR INTAKE SYSTEM RESONATOR

(75) Inventor: John F. Marentette, Tecumseh (CA)

(73) Assignee: Siemens Canada Limited, Tilbury (CA)

( * ) Notice: Subject to any disclaimer, the term of this patent is extended or adjusted under 35 U.S.C. 154(b) by 0 days.

(21) Appl. No.: 09/679,114

(22) Filed: Oct. 4, 2000

Related U.S. Application Data

(60) Provisional application No. 60/158,181, filed on Oct. 7, 1999.

(51) Int. Cl.[7] ..... F02M 35/10

(52) U.S. Cl. ..... 123/184.57; 277/207 A

(58) Field of Search ..... 123/184.53, 184.55, 123/184.57, 184.61, 184.21; 277/207 A; 285/110

(56) References Cited

U.S. PATENT DOCUMENTS 4,343,480 * 8/1982 Vassallo ..... 277/207 A
5,158,045 * 10/1992 Arthur et al. ..... 123/184.56
5,188,078 * 2/1993 Tamaki ..... 123/184.61
5,474,039 * 12/1995 Doragrip ..... 123/184.55
5,655,795 * 8/1997 Strnad et al. ..... 285/110

FOREIGN PATENT DOCUMENTS 395 465 B 1/1993 (AT) .
0 280 122 A 8/1988 (EP) .
59 103953 A 6/1984 (JP) .
10 259768 A 9/1998 (JP) .
11 107869 A 12/1998 (JP) .

OTHER PUBLICATIONS

PCT International Search Report completed Dec. 19, 2000.

* cited by examiner

*Primary Examiner*—Marguerite McMahon

(57) ABSTRACT

A simple and reliable connection between an air resonator and a throttle valve body is achieved with a resilient vacuum seal. The vacuum seal is positioned in an outer periphery of a boss on the valve body, and provides an interference fit with the resonator. The seal preferably has a seal lip extending away from the resonator such that a vacuum drawn within the resonator pulls the seal body more tightly against an inner periphery of the bore. Moreover, vibration isolator surfaces are positioned on the seal to dampen vibration between the air resonator and the valve body. The present invention thus provides a simple and secure method of connecting the air resonator to the valve body.

17 Claims, 2 Drawing Sheets

VACUUM SEAL FOR AIR INTAKE SYSTEM RESONATOR

This application claims priority to Provisional Patent Application Ser. No. 60/158,181, filed 7 Oct. 1999.

BACKGROUND OF THE INVENTION

This in invention relates to a simple and secure way for mounting a resonator into an air intake system for a vehicle, and in particular to a connection system utilizing a vacuum seal with a vibration isolator.

Vehicle engines are typically provided with an air intake system for providing clean air to the engine cylinders. A throttle valve controls the amount of air flow to the cylinder. Recently, so called electronic controls (ETC) systems have been developed wherein the throttle is controlled by an electronic control. The ETC systems are typically mounted into a housing which includes the fluid path, the throttle and an associated control. The ETC is placed between a supply of air, and the engine. There is typically a connection in the ETC body for connection to an air resonator assembly which supplies the clean air. The air resonator assembly is designed to limit noise traveling from the engine outwardly along the air flow line. Typically the air resonator is designed to provide a volume to deaden or eliminate noise from the engine. While the application specifically discloses an electronic throttle control, mechanically actuated throttle bodies will also benefit from this invention.

Typically, known air resonator systems have had a female hose which extends over a bore on the throttle body. A clamp is then tightened onto the hose, squeezing it onto the body. This connection is somewhat time consuming, and not always reliable. Hose connections do not always withstand the inherent vibration that is associated with an engine component.

SUMMARY OF THE INVENTION

In a disclosed embodiment of this invention, a connection between a air supply line component and an air resonator utilizes an internal vacuum seal sealing an interface between the two components. Most preferably, the air resonator is connected onto a boss on an ETC body. The vacuum seal is preferably mounted within a groove in an outer periphery of the boss associated with the ETC body. The vacuum seal preferably has a cylindrical lip extending in a direction away from the resonator and at an angle. Moreover, forward of the seal cylindrical lip are a pair of integrally molded bumpers or vibration isolators. The vibration isolators deaden any effect of vibration between the two components such that the connection between the two remains strong. The present invention thus allows the connection of the air resonator directly to the ETC without the requirement of any hose clamps, etc. Moreover, the connection is more reliable than the prior art given the friction connection between the two components through the use of the vacuum seal.

Again, while the invention is specifically disclosed with an ETC, mechanically actuated throttle bodies will also benefit from this invention.

These and other features of the present invention can be best understood from the following specification and drawings, the following of which is a brief description.

DETAILED DESCRIPTION OF A PREFERRED EMBODIMENT

Figure 1A:
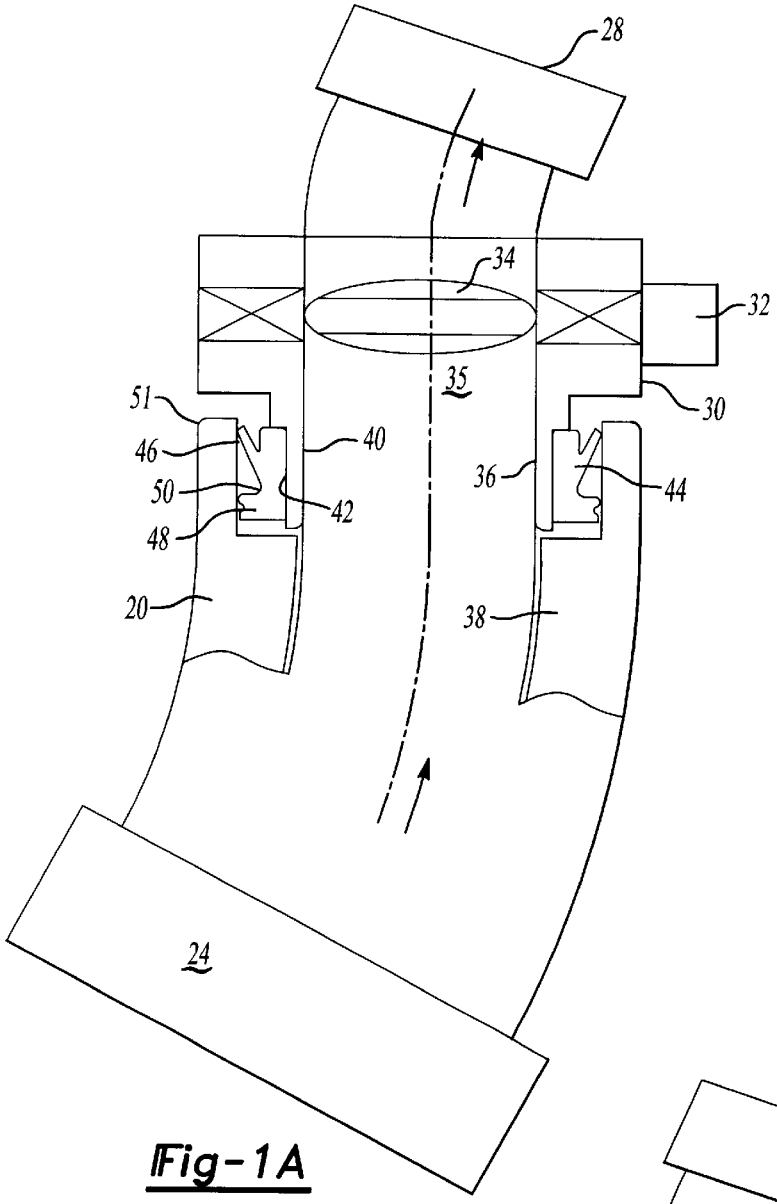
FIG. 1A shows a schematic view of the inventive system with an air resonator attached.

An air resonator body 20 is connected to an air cleaner 24 for delivery of clean air to a vehicle engine 28. The air flows through an air supply line. An electronic throttle control (ETC) body 30 is mounted between resonator 20 and the engine 28. A control 32 and an associated throttle valve 34 are positioned within the internal flow line 35 in body 30. Upstream of the throttle 34 is a connection 36 for communicating the line 35 to the air resonator body 20. As shown, the air resonator body has a path 38 communicating with the passage 36, and communicating with an internal volume in the air resonator body 20, as is known. The basic structure of the ETC 30 and the air resonator 20 are as known. It is the connection between the two which is inventive here.

A boss 40 extends downwardly to define passage 36. A groove 42 is formed in the outer periphery of the boss 40. A vacuum seal 44 is positioned within the groove 42. The vacuum seal is preferably molded out of a suitable rubber or elastomer, in one preferred embodiment was formed of a silicon rubber.

An integral seal lip 46 extends away from the air resonator at an angle from the remainder of the body of the seal 44. Bumpers or vibration isolator 48 are also positioned between the boss 40 and the inner periphery 50 of a neck portion 51 of the resonator body 20. As shown, when the air resonator 20 is forced onto the boss 40, the inner diameter 50 of the neck 51 squeezes the seal 40, its seal lip 46, and the vibration isolators 48 away from a free position. An interference fit between the seal 44 and the inner periphery 50 is sufficient to retain the air resonator 20 solidly on the boss 40. In one preferred embodiment, the interference fit between the lip 46 in its free position and the inner periphery 50 is on the order of 5 millimeter.

Figure 1B:
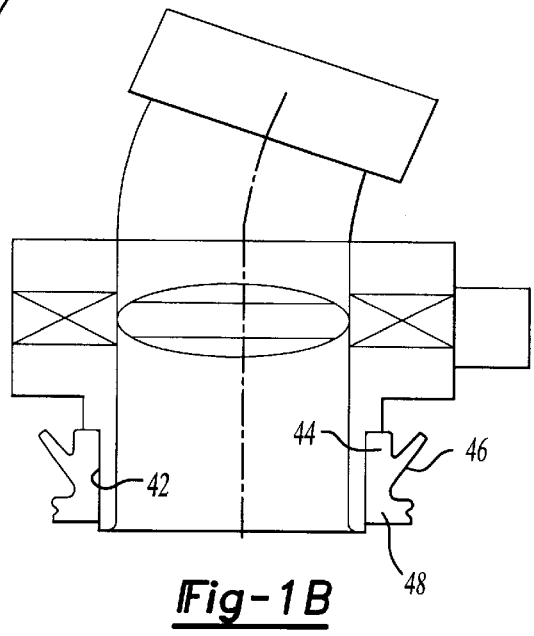
FIG. 1B shows the air resonator removed.

As shown in FIG. 1B, before the resonator body 20 is attached, the seal 44 is at its free position. As mentioned above, in the free position, the lip 46 extends approximately 5 millimeters radially outwardly from the position shown in FIG. 1A.

Figure 2:
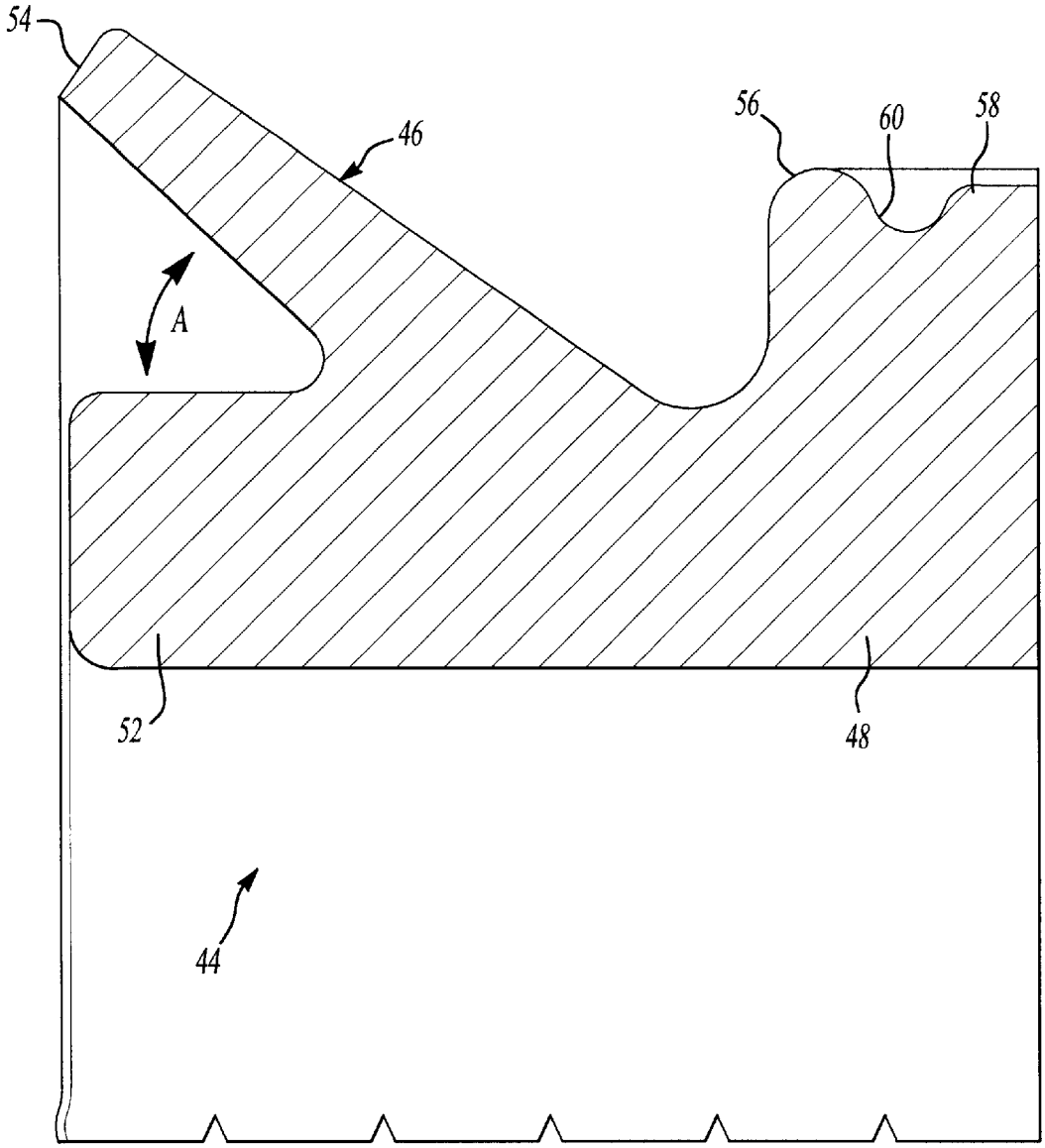
FIG. 2 is a cross-sectional view of the inventive seal.

As shown in FIG. 2, lip 46 extends at an angle A from a rear body 52 of the seal 44. An end 54 of the seal lip 46 has an extreme portion which is spaced from a central axis X of the seal 44 by 5 millimeters more than the inner periphery 50 of the air resonator 20. In a preferred embodiment, the angle A is approximately 45°.

As shown, the vibration isolator 48 is preferably formed of a pair of lips 56 and 58. In a preferred embodiment the lip 56 extends slightly radially outwardly more than the lip 58. A central valley 60 is positioned between the two. The use of the two spaced lips 56 and 58 ensure adequate vibration isolation between the connection and the vacuum seal, 44. Moreover, the lip 46, by extending away from the air resonator 20, is pulled further into contact with the inner periphery 50 by a vacuum drawn within the passages 36 and 38. In this way, a more fluid tight seal is ensured. It is desirable to ensure a fluid tight seal, as dirty air which passes seal 44 moves into the passage 45 and potentially to the engine 28, which would be undesirable.

In summary, the present invention discloses a unique connection between an air resonator and an ETC valve or other throttle body. The unique connection provides a simplified and more beneficial connection between the two. A worker in this art would recognize that various modifications would come within the scope of this invention, and for that reason the following claims should be studied to determine the true scope and content of this invention.

What is claimed is:

1. An air supply system for a vehicle engine comprising:

a throttle body including a flow passage for communicating with an air resonator body, and for communicating with a vehicle engine; and an air resonator attached to said throttle body and communicating with said passage, one of said throttle body and said air resonator having a boss extending downwardly into an opening in the other, and a resilient seal positioned between said boss and an inner periphery of said other of said throttle body and said air resonator, said resilient seal providing an interference fit for securing said air resonator to said throttle body, said interference fit being sufficient to solidly retain said air resonator on said throttle body.

2. A system as set forth in claim 1, wherein said boss extends downwardly from said throttle body.

3. A system as set forth in claim 2, wherein a circumferential groove is formed into an outer periphery of said boss and said seal is positioned in said groove.

4. An air supply system for a vehicle engine comprising:

a throttle body including a flow passage for communicating with an air resonator body, and for communicating with a vehicle engine;

an air resonator attached to said throttle body and communicating with said passage, one of said throttle body and said air resonator having a boss extending downwardly into an opening in the other, and a resilient seal positioned between said boss and an inner periphery of said other of said throttle body and said air resonator, said resilient seal providing an interference fit for securing said air resonator to said throttle body;

said boss extending downwardly from said throttle body;

a circumferential groove formed into an outer periphery of said boss and said seal positioned in said groove; and said seal has a seal lip extending in a direction away from said air resonator such that a vacuum drawn within said air resonator tends to force said seal further into contact with said bore.

5. A system as set forth in claim 4, wherein a vibration isolator is positioned axially inward from said seal lip.

6. A system as set forth in claim 5, wherein said seal lip extends at an angle radially outwardly and axially away from said air resonator.

7. A system as set forth in claim 5, wherein said vibration isolator includes a pair of vibration isolator lips with a central valley between the two.

8. A system as set forth in claim 7, wherein said seal lip extends radially outwardly for a greater extent than said vibration isolators.

9. A system as set forth in claim 1, wherein said throttle body is an ETC valve body.

10. A system for connecting an electronic throttle control body to an air resonator comprising:

an electronic throttle body including a throttle valve positioned in a passage, said passage communicating between an air resonator and an engine, an air resonator assembly connected to communicate with said passage, and a connection between said air resonator system and said ETC body including a seal position between a boss and an inner peripheral bore, said boss being formed on one of said ETC body and said air resonator and said bore being formed on the other, said resilient seal having a free dimension which is of a radially greater dimension than an inner periphery of said bore, such that said air resonator is interference fit on said valve body, said interference fit being sufficient to solidly retain said air resonator on said throttle body.

11. A system as set forth in claim 10, wherein said boss extends from said ETC body.

12. A system as set forth in claim 11, wherein a circumferential groove is formed into an outer periphery of said boss and said seal is positioned in said groove.

13. A system for connecting an electronic throttle control body to an air resonator comprising:

an electronic throttle body including a throttle valve positioned in a passage, said passage communicating between an air resonator and an engine, an air resonator assembly connected to communicate with said passage, and a connection between said air resonator system and said ETC body including a seal position between a boss and an inner peripheral bore, said boss being formed on one of said ETC body and said air resonator and said bore being formed on the other, said resilient seal having a free dimension which is of a radially greater dimension than an inner periphery of said bore, such that said air resonator is interference fit on said valve body;

said boss extending from said ETC body;

a circumferential groove formed into an outer periphery of said boss and said seal positioned in said groove;

said seal has a seal lip extending in a direction away from said air resonator such that a vacuum drawn within said air resonator tends to force said seal further into contact with said bore.

14. A system as set forth in claim 13, wherein a vibration isolator is positioned axially inward from said seal lip.

15. A system as set forth in claim 14, wherein said seal lip extends at an angle radially outwardly and axially away from said air resonator.

16. A system as set forth in claim 14, wherein said vibration isolator includes a pair of vibration isolator lips with a central valley between the two.

17. A system as set forth in claim 16, wherein said seal lip extends radially outwardly for a greater extent than said vibration isolators.

* * * * *